United States Patent [19]

McDaniel, Jr.

[11] 4,216,735

[45] Aug. 12, 1980

[54] MULTI-COLORED TUFTED CARPET AND METHOD OF PRODUCING SAME

[75] Inventor: Ollie F. McDaniel, Jr., Rome, Ga.

[73] Assignee: WWG Industries, Inc., Rome, Ga.

[21] Appl. No.: 906,475

[22] Filed: May 17, 1978

[51] Int. Cl.[2] ..... D05C 17/02

[52] U.S. Cl. ..... 112/410; 8/483; 28/160; 428/89

[58] Field of Search ..... 28/160, 218; 8/1 XB, 8/14, 21 B, 21 C; 428/89; 112/410

[56] References Cited

FOREIGN PATENT DOCUMENTS

| | | | |
|---|---|---|---|
| 47-19166 | 9/1972 | Japan | 28/160 |
| 1017155 | 1/1966 | United Kingdom | 8/21 B |
| 1041240 | 9/1966 | United Kingdom | 28/160 |

OTHER PUBLICATIONS

Hall, A. J. *The Standard Handbook of Textiles* N.Y., Halsted Press, 1975, pp. 64, 65, 82–85, 258, 259, 302–311.

*Practicality of Dyeing Blends,* DuPont Textile Fibers Technical Information, Multi-fiber, Bulletin X-100, Feb., 1959.

*Production of a Multicoloured Thread,* Belgian Patents Report No. 9/68, No. 703060. Aug. 1967.

*Primary Examiner*—Robert Mackey

*Attorney, Agent, or Firm*—Beveridge, DeGrandi, Kline & Lunsford

[57] ABSTRACT

A patterned, multi-colored carpet is achieved by space dyeing a polyester of a polypropylene yarn, tufting the spaced dyed yarn and an undyed yarn having a susceptibility to a dye to which the polyester or polypropylene yarn is not susceptible in alternating rows by a high/low technique to form a carpet having a high/low design thereon, and thereafter dyeing the undyed yarn.

This invention relates to a method of making a multicolored patterned carpet and more particularly a multi-colored patterned tufted carpet.

10 Claims, 2 Drawing Figures

MULTI-COLORED TUFTED CARPET AND METHOD OF PRODUCING SAME

BACKGROUND OF THE INVENTION

The ever changing public taste has required manufacturers of tuft carpeting to produce a large variety of multi-colored patterns on carpeting and other pile fabrics. Such multi-colored effects can be in a predetermined pattern or in a non-repetitive color pattern. Various methods have been proposed to accomplish this result.

In tufted carpets, many methods are available in the prior art for varying the pile height of an individual loop or loop later cut for cut pile. In the most basic form of the case of a loop pile carpet, the yarn fed to the machine is suddenly red uced in length. Since the machine has been set to produce a loop of a given height, the only way for the machine to complete its cycle is to pull back yarn from the previous loop. Thus, by alternating the full loop rate of yarn feed with a lower low loop rate of yarn feed, two heights of loops can be produced. When assembled in the carpet, the high and low loops in adjacent warped ends of pile yarn combine to give areas of pattern demarcated by high or low loop areas.

When there are two rows of high loops adjacent to a center row of low loops, the high loops will spread over the low loops and only the high loops will be on the surface of the carpet. Thus, if a carpet was made of alternating warped pile yarns of red and blue yarns using a design which controlled the loop heights, it is possible to produce areas containing low red - low blue loops, high red - low blue loops, high blue - low red loops, and high blue - high red loops. The low red - low blue and high red - high blue areas would appear purplish, the high red - low blue would appear red since the blue color would be hidden, and the high blue - low red would be blue since the red yarn would be hidden.

The patterned devices which are used to regulate the yarn feed to loop pile machines are multi feed rolls, slats and scrolls. Most machines available on the market provide a choice of three pile heights, which can be set to give a chosen difference.

The carpet industry basically dyes carpet or yarn by two broad techniques. The first is space dyeing in which the carpet or yarn within a given area or space is dyed and a variety of space dyeing technqiues are available. The other basic technique is a splattering technqiue where drops of color are sprinkled or splattered on the carpet or yarn to provide a multi-hued effect. Tak dyeing is an example of such latter technique. The splattering techniques are generally less expensive and more economical than space dyeing techniques.

It is the object of this invention to provide a method of making a patterned, multi-colored carpet in which a wide variety of patterns and a wide variety of multi-hued effects can be achieved easily and economically. This and other objects of the invention will become apparent to those skilled in the art following the detailed description.

SUMMARY OF THE INVENTION

This invention relates to a method of making a multi-colored, patterned carpet. More particularly, the method involves a space dyeing of a polyester or polypropylene yarn, tufting the space dyed yarn and an undyed yarn which has a different dye susceptibility in alternating rows by a high/low technique in order to form a carpet having a high/low design or pattern thereon, and thereafter dyeing the undyed yarn.

THE DRAWINGS

DESCRIPTION OF THE INVENTION

Figure 1:
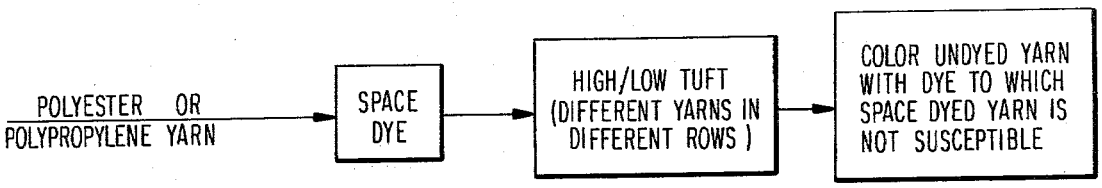
FIG. 1 is a flow chart of the method.
Figure 2:
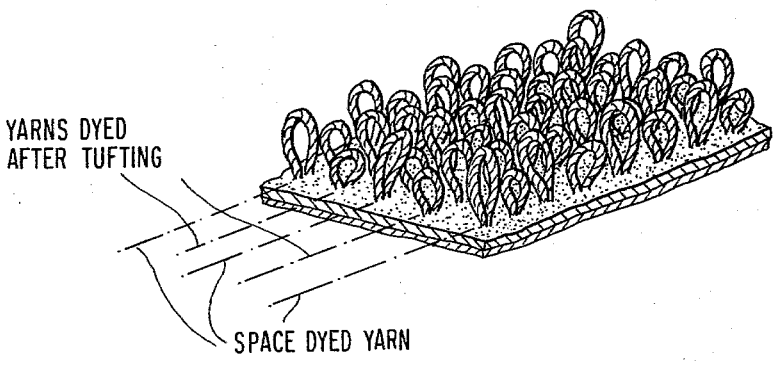
FIG. 2 is a schematic drawing of the product manufctured .

In accordance with the present invention, a carpet is polyester yarn or a polypropylene yarn which can be space dyed. The second yarn can be any other type of yarn such as nylon, or when the first yarn is a polypropylene yarn, polyester yarn. It is necessary that the second yarn have a susceptibility to a dye which the polyester or polypropylene yarn, whichever is used, does not have.

In the instant process, the polyester or polypropylene yarn is space dyed to achieve whatever color or color combinations are desired . The space dyed yarn and the second yarn, which is undyed, are then tufted into a carpet by the high/low technique discussed previously. As a result, a carpet is formed having a high/low design thereon with one of the yarns being the colored polyester or polypropylene yarn and the other yarn being undyed. Thereafter, the undyed yarn is colored by any suitable technique such as tak dyeing, beck dyeing, application of Kuster continuous dye, or by printing. Whatever dyeing technique is chosen, it is necessary that the spaced dyed yarn is not susceptible to the dye employed therein. For example, when the first yarn is a polyester, the second yarn can be nylon which is susceptible to acid dyes. Similarly, if the first yarn is polypropylene which is susceptible to nickel chelate dyes, the second yarn can be a polyester (susceptible to dispersed dyes) or nylon (which is susceptible to disperse or acid dyes).

In accordance with the present invention, a polyester yarn was spaced dyed alternately with brown and gold dyes along its length. The polyester yarn was then tufted in alternate rows with an undyed nylon yarn in a conventional cut loop machine by the high/low technique. This machine produces a high cut pile or a low loop pile at the command of the patterning device. In this case, the patterning device kept each loop of the space dyed polyester in the low loop configuration and varied the undyed nylon yarn between high loop or low loop. Thus, the nylon yarn (undyed) was planted alternately with the pre-dyed polyester, gold and brown yarn.

The partially colored fabric after tufting was then subjected to tak dyeing and only acid dyes were used in the latter dyeing process. The acid dyes do not dye polyester but they do dye the nylon. As a result, the undyed nylon was multi-colored in the tak process without changing any of the colors of the polyester.

The instant process provides a much greater coloring potential than tak dyeing alone. In the space dyeing process used, six separate colors can be applied to the polyester. In the tak dyeing, a ground color can be overprinted with four colors and these can be modified along the cut pile yarn axis. The fabric containing the spaced dyed yarn can be changed into many other colorations by the tak dyeing as the color designer identifies pleasing combinations and a small number of space dyed polyesters will provide base fabric for a much larger color range of finished product. The instant system is more economical than systems in which both yarns are space dyed since tak dyeing is a cheaper process to realize. It also allows longer runs of space dyed yarn since a single color combination in the space dyeing produces several differently colored carpets after tak dyeing.

If an undyed fabric of nylon and undyed polyester are tak dyed, it is not possible to achieve the same effects as realized by the instant invention since the disperse dyes which dye the polyester will also dye the nylon.

While it is possible to use an acid dyeing nylon and a basic (cationic) dyeing nylon to produce multiple colorations of the same type by tak dyeing, severe dye complications arise and there is some cross staining of the dyes on the wrong fiber. Further, applying so many colors at the same time makes accurate color matching and reproduction very difficult. It is further not possible to make two runs through the tak dyeing process since the pattern achieved would be different; in multi-tak processes, the pattern produced by the scraper blades are rarely, if ever, in phase through the two separate runs.

Various changes and modifications can be made in the process of the instant invention without departing from the spirit and scope thereof. The various embodiments disclosed herein were for the purpose of illustrating the invention only and were not intended to be limiting.

What I claim is:

1. A method of making a multi-colored patterned carpet which consists essentially of space dyeing a yarn selected from the group consisting of polyester and polypropylene yarns, tufting said space dyed yarn and an undyed yarn having a susceptibility to a dye to which the space dyed yarn is non susceptible in alternating rows by a high/low technique to form a carpet having a high/low design thereon, and thereafter dyeing said undyed yarn with a dye to which the space dyed yarn is not susceptible.

2. The method of claim 1 wherein said undyed yarn is a nylon yarn.

3. The method of claim 1 wherein said undyed yarn is dyed by tak dyeing.

4. The method of claim 1 wherein said space dyed yarn is a polyester yarn and is space dyed with a disperse dye, and wherein said undyed yarn is a nylon yarn which is dyed by tak dyeing with an acid dye.

5. The method of claim 1 wherein said undyed yarn is a polyester yarn.

6. The method of claim 1 wherein said space dyed yarn is a polypropylene yarn and is dyed with a nickel chelate dye.

7. The method of claim 6 wherein said undyed yarn is a polyester yarn which is dyed with a disperse dye.

8. The method of claim 6 wherein said undyed yarn is a nylon yarn and is dyed with a disperse dye.

9. The method of claim 6 wherein said undyed yarn is a nylon yarn and is dyed with an acid dye.

10. A multi-colored patterned carpet produced by the method of claim 1.

* * * * *